US009101190B2

(12) United States Patent
Noble

(10) Patent No.: US 9,101,190 B2
(45) Date of Patent: Aug. 11, 2015

(54) HANDLE LIGHT

(75) Inventor: Matthew D. Noble, Los Angeles, CA (US)

(73) Assignee: Custom LeatherCraft Manufacturing Company, Inc., South Gate, CA (US)

( * ) Notice: Subject to any disclaimer, the term of this patent is extended or adjusted under 35 U.S.C. 154(b) by 994 days.

(21) Appl. No.: 13/187,745

(22) Filed: Jul. 21, 2011

(65) Prior Publication Data

US 2013/0021787 A1 Jan. 24, 2013

(51) Int. Cl.

| | |
|---|---|
| ***A45C 13/28*** | (2006.01) |
| ***B25H 3/02*** | (2006.01) |
| ***A45C 15/06*** | (2006.01) |
| ***F21V 33/00*** | (2006.01) |
| ***F21V 21/30*** | (2006.01) |
| *F21S 9/02* | (2006.01) |
| *F21S 9/03* | (2006.01) |
| *F21V 23/04* | (2006.01) |
| *F21Y 101/02* | (2006.01) |

(52) U.S. Cl.

CPC ..... *A45C 13/28* (2013.01); *A45C 15/06* (2013.01); *B25H 3/02* (2013.01); *F21V 21/30* (2013.01); *F21V 23/0471* (2013.01); *F21V 23/0492* (2013.01); *F21V 33/0004* (2013.01); *F21V 33/0084* (2013.01); *F21S 9/02* (2013.01); *F21S 9/03* (2013.01); *F21V 23/0464* (2013.01); *F21Y 2101/02* (2013.01)

(58) Field of Classification Search

CPC ..... A45C 15/06; A45C 13/28; F21V 33/00; F21V 33/0084; F21V 33/0004; F21V 21/30; B25H 3/02

USPC ..... 362/156

See application file for complete search history.

(56) References Cited

U.S. PATENT DOCUMENTS

| | | | | |
|---|---|---|---|---|
| 2,554,603 | A * | 5/1951 | Terlinde | 362/577 |
| 2,644,882 | A * | 7/1953 | Voda | 362/94 |
| 4,855,881 | A * | 8/1989 | Pence | 362/156 |
| 5,913,671 | A * | 6/1999 | Fernandez et al. | 43/18.1 R |
| 6,135,621 | A * | 10/2000 | Bach et al. | 362/399 |
| 6,409,357 | B1 * | 6/2002 | Thompson et al. | 362/98 |
| 7,147,342 | B2 * | 12/2006 | Burnidge | 362/156 |
| 7,404,506 | B1 * | 7/2008 | Ross | 224/576 |
| 8,256,793 | B1 * | 9/2012 | Krieger | 280/650 |
| 8,485,329 | B1 * | 7/2013 | Roy et al. | 190/116 |
| 2002/0116791 | A1 * | 8/2002 | Grady et al. | 16/444 |
| 2003/0002276 | A1 * | 1/2003 | Chen | 362/109 |
| 2007/0103892 | A1 * | 5/2007 | McDaniel et al. | 362/119 |
| 2008/0011568 | A1 * | 1/2008 | Siwak et al. | 190/115 |
| 2010/0033960 | A1 * | 2/2010 | Levine | 362/198 |
| 2010/0232147 | A1 * | 9/2010 | Bryant et al. | 362/183 |

* cited by examiner

*Primary Examiner* — Mary McManmon

(57) ABSTRACT

A lighting device including at least one light source and a light source body attached to the light source. The light source body rotates for multi-positional lighting.

8 Claims, 10 Drawing Sheets

HANDLE LIGHT

BACKGROUND

1. Field

The embodiments relate to lighting sources, and in particular to lighting sources for handles.

2. Description of the Related Art

Utility bags are used for carrying tools, supplies and accessories for professionals as well as non-professionals. Utility bags may be used in the day time or at night. A person using a utility bag at night typically requires the use of a light source, such as a flashlight or lamp.

Using a lamp is sometimes inappropriate due to the working area. Carrying the extra weight of a flashlight or use of a flashlight may be inconvenient, especially when a person carrying a tool or utility bag has their hands full.

SUMMARY

One embodiment of the invention includes a lighting device. The lighting device including at least one light source and a light source body attached to the light source. The light source body rotates for multi-positional lighting.

Another embodiment of the invention comprises a utility bag. The utility bag including at least one light source coupled to a light source handle. A mounting device is coupled to a utility bag handle and the light source handle. The light source handle rotates for targeting lighting.

Yet another embodiment of the invention comprises a lighting device kit. The lighting device kit includes a light source body including a first body portion and a second body portion. The first body portion removably couples with the second body portion. A light source is coupled to the first body portion. The light source body is removably coupled to a handle. The light source body rotates.

Still another embodiment of the invention comprises a bucket including at least one light source coupled to a light source handle. A mounting device is coupled to a bucket handle and the light source handle. The light source handle rotates for targeting lighting.

Other aspects and advantages of the present invention will become apparent from the following detailed description, which, when taken in conjunction with the drawings, illustrate by way of example the principles of the invention.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The description may disclose several preferred embodiments of light sources for handles, as well as operation and/or component parts thereof. While the following description will be described in terms of handle light sources and devices for clarity and to place the invention in context, it should be kept in mind that the teachings herein may have broad application to all types of systems, devices and applications.

One embodiment of the invention provides a lighting device. The lighting device including at least one light source and a light source body attached to the light source. The light source body rotates around a handle for multi-positional lighting.

Figure 1:
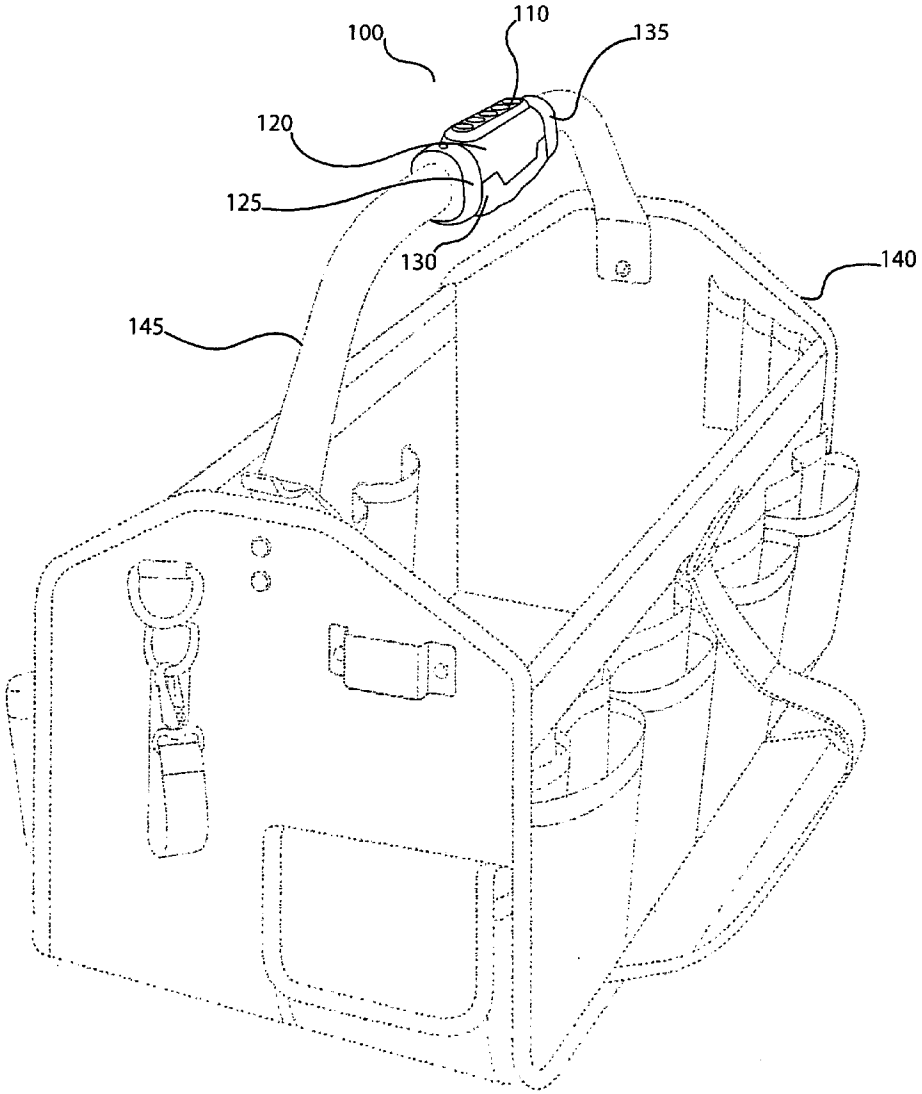
FIG. 1 illustrates a perspective view of a light source according to one embodiment of the invention.

FIG. 1 illustrates a lighting source 100 for a handle of a tool, device or utility bag 140 (e.g., an open/closed tool bag, accessory bag, etc.) according to one embodiment of the invention. In one embodiment of the invention, the lighting source 100 includes a lighting source housing including an upper portion 129 and a lower portion 130 that are connected to swivel anchor devices 125 and 135. In one example, the lighting source device 100 is attached to a handle 145 of a utility bag 140. In one embodiment of the invention, the lighting source 10 includes a lighting element 110. In one example, the lighting element 110 includes a plurality of light emitting diodes (LEDs), such as two, three, four, five, etc.

Figure 2:
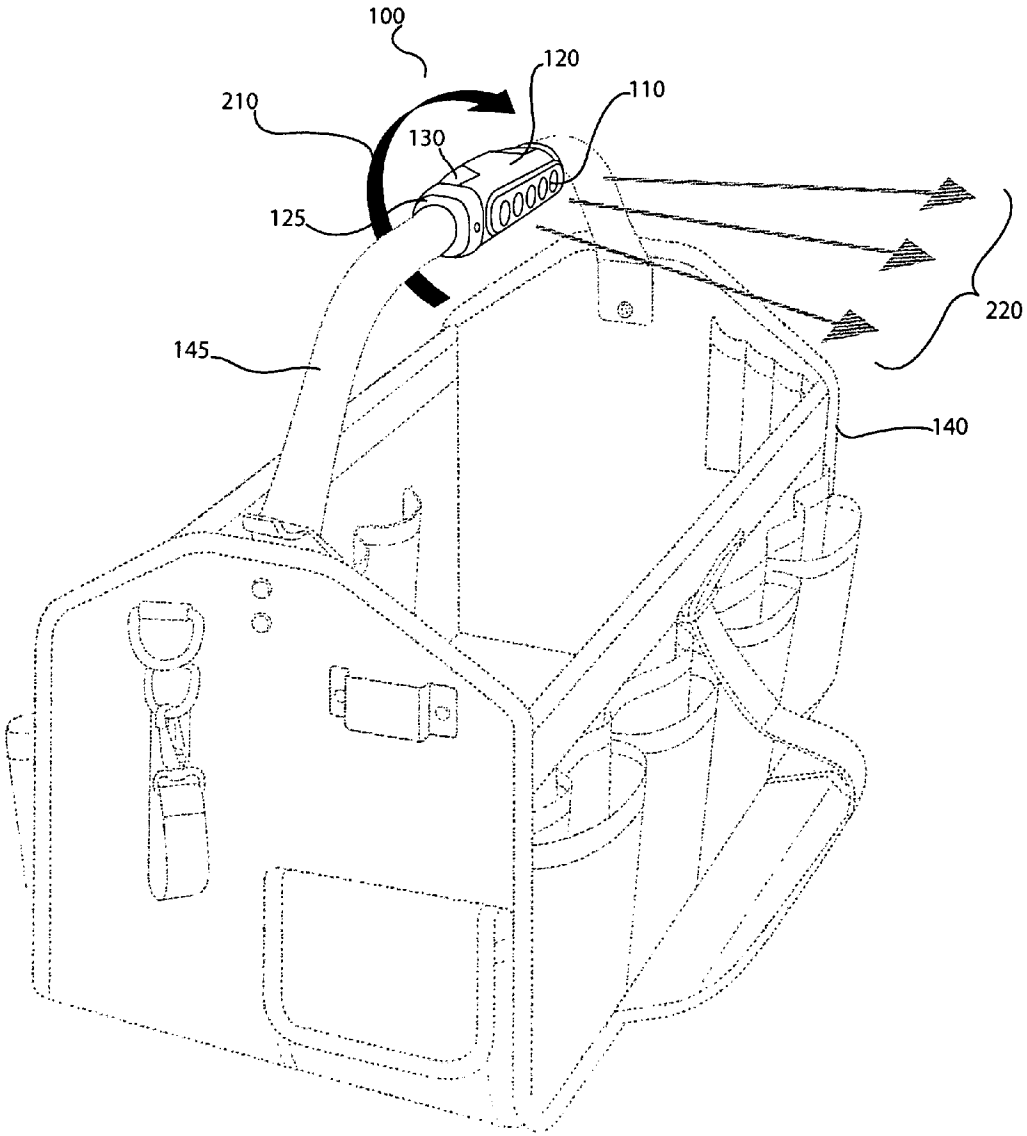
FIG. 2 illustrates a perspective view of a light source shown moving to a first position for lighting according to one embodiment of the invention.

FIG. 2 illustrates the lighting source 100 for a handle shown moving to an on or lighted state in the direction of the arrow 210 according to one embodiment of the invention. In this example, the lighting element 110 provides light in the direction of the arrows 220. In one embodiment of the invention, the lighting source housing including an upper portion 120 and lower portion 130 may rotate clockwise or counterclockwise to provide light in the direction of the sides of the utility bag 140. In one example, the lighting source housing is attached to the handle 145 of the utility bag 140 via a compression means for attaching. In one embodiment of the invention, the anchor devices 125 and 135 rotate with the lighting source housing. In other embodiments of the invention, the anchor devices 125 and 135 are stationary and anchor the lighting source housing to the handle 145 of the utility bag 140, where the lighting source housing rotates around the handle 145. In one example an interior sleeve (not shown) is used for providing the rotation of the light source 100. IN this example, a cam or ratchet type of movement provides for the light source 100 to be rotated in fixed or predetermined positions, such as 90°, 180°, etc. In another example, the light source 100 may be rotated freely and locks or remains in a desired position based on friction between the sleeve and the light source 100.

Figure 3:
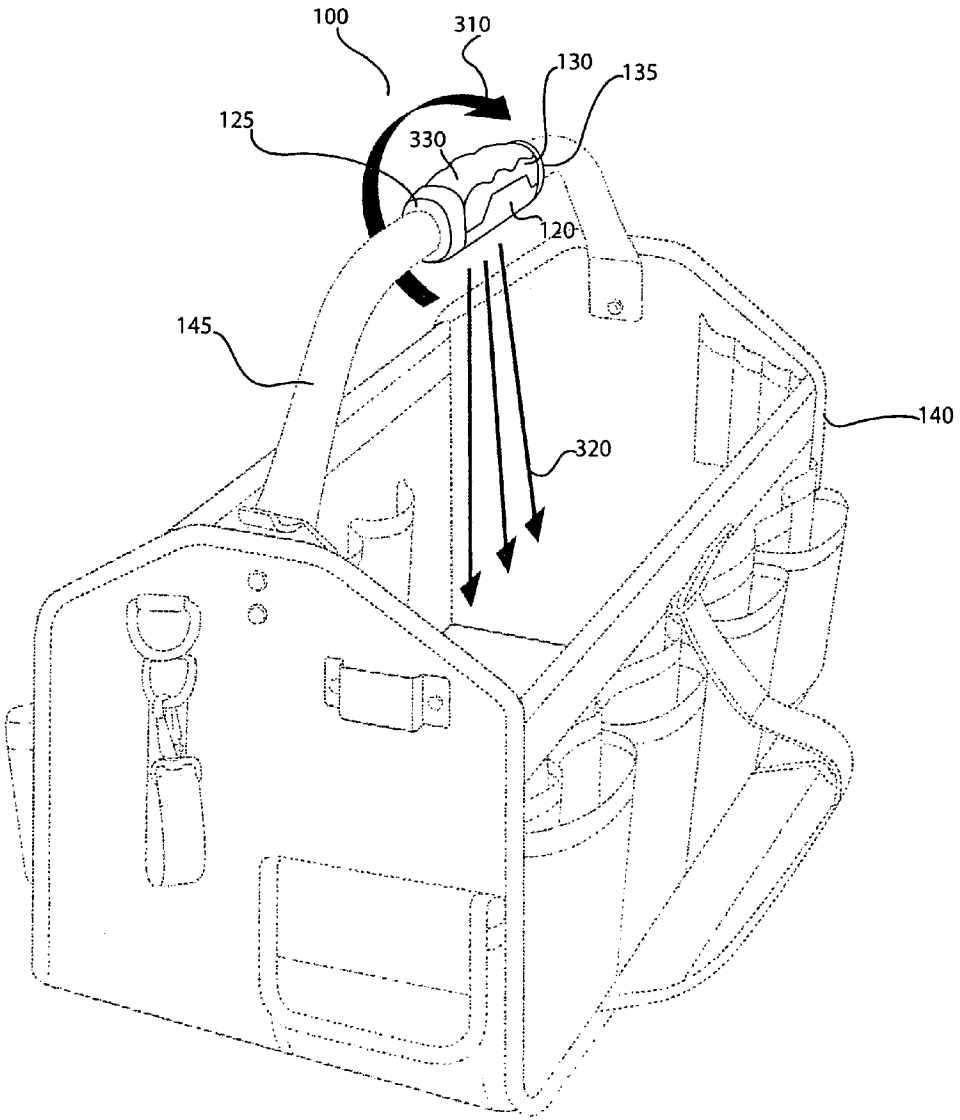
FIG. 3 illustrates a perspective view of a light source shown moving to a second position for lighting according to one embodiment of the invention.

FIG. 3 illustrates a perspective view of the light source 100 attached to a handle 145 of a utility bag 140 that is rotated in the direction of the arrow 310 to provide light in the direction of the arrows 320 according to one embodiment of the invention. In one example, the lighting element 110 may comprise any combination of colored lighting, such as white, red, green, yellow, infrared, etc.

In one embodiment of the invention, the lighting source 100 may rotate between 0°-180°. In other embodiments of the invention, the lighting source may rotate 360°. The rotation functionality of the lighting source 100 provides precision targeted lighting in many directions, including within the utility bag 140, the sides of the utility bag 140, and away from the utility bag 140, which provides precision lighting to areas external to the utility bag 140 (e.g., working areas, front/rear pathways, etc.).

In one example, the lighting source housing may rotate in increments via a ratcheting mechanism that provides increments, such as in 15°, 30°, 45°, 90°, etc. increments of rotation, where the lighting source housing is ratcheted to a releasable locked position in each increment. In one embodiment of the invention, the lighting source housing is permanently fixed to the handle 145 of the utility bag 140. In other embodiments of the invention, the lighting source housing may be removably coupled to the handle 145.

Figure 4:
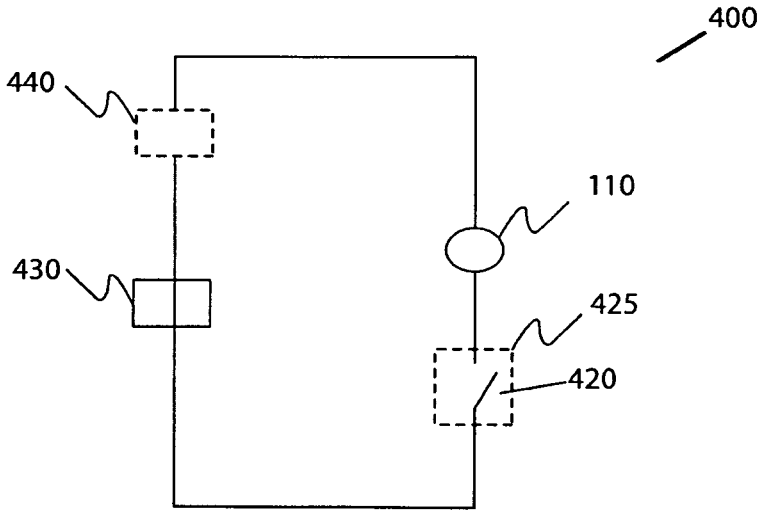
FIG. 4 illustrates a circuit diagram for a light source according to one embodiment of the invention.

FIG. 4 illustrates a circuit 400 for the light source 100 for attaching to a handle of a device, tool or the handle 145 of a utility bag 140 according to one embodiment of the invention. In one embodiment of the invention, the circuit 400 for the light source 100 includes the lighting element 110, a switch 420, a power source 430 and optional sensor 440. In one example, the switch 420 may comprise a slide switch, a push button switch, etc. In one example, the switch 420 is disposed on the lighting source housing on either the upper portion 120 or lower portion 130 (e.g., on the outer top portion, a side portion, an inner portion, etc.).

In one embodiment of the invention, the switch 420 may comprise a user lighting selection functionality for controlling amount the lighting element 110 by means of a controller circuit 425. In one example, the switch 420 and controller circuit 425 may be user selectable to light on a portion of LEDs of the lighting element 110 (e.g., one, two, three, all, etc.). In another example, the switch 420 and controller circuit 425 may be user selectable to select a particular color of LEDs of the lighting element 110 (e.g., white, red, green, yellow, etc.). In yet another example, the switch 420 and controller circuit 425 may be user selectable to select solid or blinking LEDs of the lighting element 110.

In one example, the sensor 440 may comprise a position determining sensor, a motion sensor, a light sensor, or any combination of various sensors to provide control of the switch 420. In one example, upon employing a position determining sensor as sensor 440, rotating the lighting source housing to an on state (e.g., a positioning away the lighting element 110 from facing up) closes the switch 420, which provides voltage to the lighting element 110, and moving the lighting source housing back to the facing upward position opens the switch 420 cutting off voltage to the lighting element 110.

In one example, upon employing a motion sensor as sensor 440, a timer regulates the time that the switch 420 is closed based on sensing motion within a predetermined distance from this sensor 440 disposed on the lighting source housing. In one embodiment of the invention, the predetermined motion sensing distance is adjustable by a user from 1 ft.-15 ft. In another embodiment of the invention, the predetermined motion sensing distance is preset between distances of 1 ft-3 ft. In one example, the motion sensor may be turned on or off so that the switch 420 may be manually set on/off. In one embodiment of the invention, the timer may be user adjustable or preset to a particular amount of time. In one example, the timer may be adjusted from 5 seconds to 15 minutes. In another example, the timer is preset between 30 seconds and one minute. The use of the motion sensor provides lighting in the set direction of the lighting source housing by sensing motion without a user having to manually press/slide the switch 420.

In one example, upon employing a light sensor as sensor 440, when the switch is placed in an on position, the sensor 440 will not close the circuit 400 unless the sensor 440 senses that not enough light is within the proximity of the light sensor (i.e., the area is dark enough to necessitate lighting the area). In one example, the light sensor 440 may be positioned on the sides, exterior or interior portions of the lighting source housing. In one example, employing the light sensor 440 provides energy saving when lighting the light source 100 is not necessary based on available ambient light. In one example, the light sensor 440 may be manually overridden.

In one example, the sensor 440 may include any combination of sensors, such as motion and light sensors, position and light sensors, etc.

In one embodiment of the invention, the power source 430 comprises rechargeable or non-rechargeable batteries selected based on the number of LEDs and/or voltage required to power the lighting element 110. In one example, a solar charging circuit is employed to store energy in a rechargeable battery of power source 430. In one example, the solar charging circuit may be disposed on the outer portion of the lighting source housing. In another example, an adapter or plug in socket may be employed with the lighting source 100 to connect to an external power source, such as a battery pack from an electric tool (e.g., electric drill, hammer, screwdriver, etc.), separate additional battery pack, an AC/DC power supply, etc.

Figure 5:
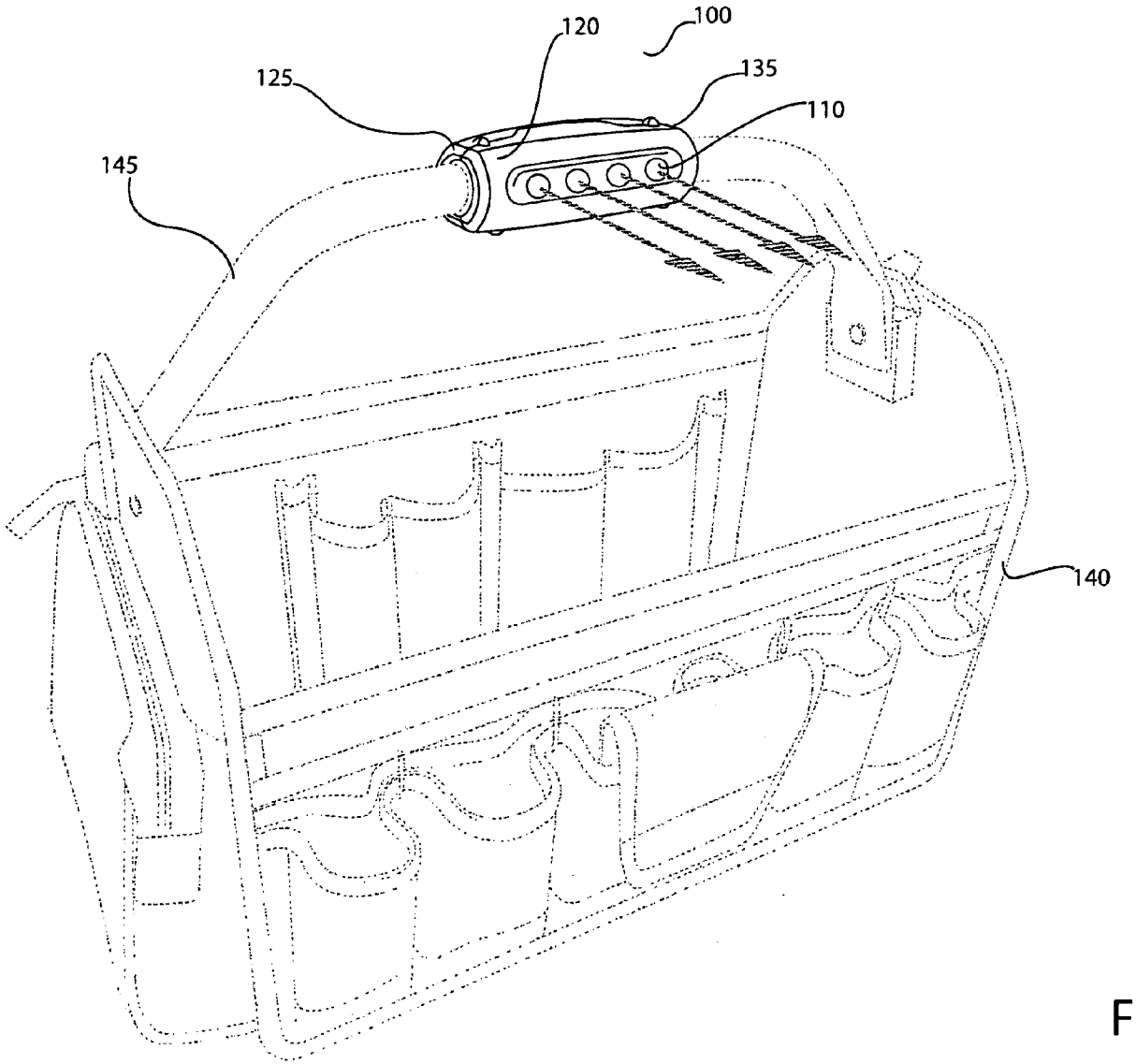
FIG. 5 illustrates a perspective view of a light source attached to a utility bag according to another embodiment of the invention.

FIG. 5 illustrates a perspective view of a light source 100 for a utility bag 140 providing light in the direction of the arrows according to another embodiment of the invention. As illustrated, the light source 100 is positioned on a handle 145 of the utility bag 140. As illustrated, lighting source 100 is rotated about 90° from an upward facing position to a side facing position to provide targeted lighting. In one example, the lighting source 100 may be positioned to target lighting inside the utility bag 140 or external to the utility bag 140, depending on lighting needs of a user.

In one embodiment of the invention, the lighting source 100 may vary in size. In one example, width of the lighting source 100 may range in width from 1 inch-3 inches, preferably between 1.5 inches-2.5 inches; and the length of the lighting source 100 may range from 5 inches-12 inches, preferably between 6 inches-8 inches. It should be noted that the lighting source 100 may be customized and fit according to necessity and desire of the user, and based on the diameter of the handle 145 of the utility bag 140 used.

In other examples, other types of light sources may be employed with lighting element 110, such as Electroluminescent (EL) light sources, etc. In one embodiment of the invention, the lighting source 100 includes glow-in-the-dark material.

In one example, the lighting source 100 may be made of one or more of: reinforced polypropylene, polypropylene, high-density polyethylene, nylon material, hardened plastic, polymer, rubber, composite material, metal or metal alloy, etc., or other similar or equivalent materials.

In one example, the removed lighting source housing 110 may be attached to other handles, such as handles of a tool, a rung portion of a ladder, a broom, a shovel, etc. to provide user directed targeted lighting.

In one embodiment of the invention, the lighting source 100 may be provided as a kit to be attached to an existing handle of a device, tool or a handle 145 of a utility bag 140. In one example, the lighting source 100 includes is attached around the handle 145 as the anchor devices 125 and 135 comprise at least two portions that attach to one another to couple around the handle 145. In one example, the anchor devices 125 and 135 are attached to the handle 145 via compression means (e.g., clamping, friction tightening, etc.), or other similar means for attaching.

Figure 6:
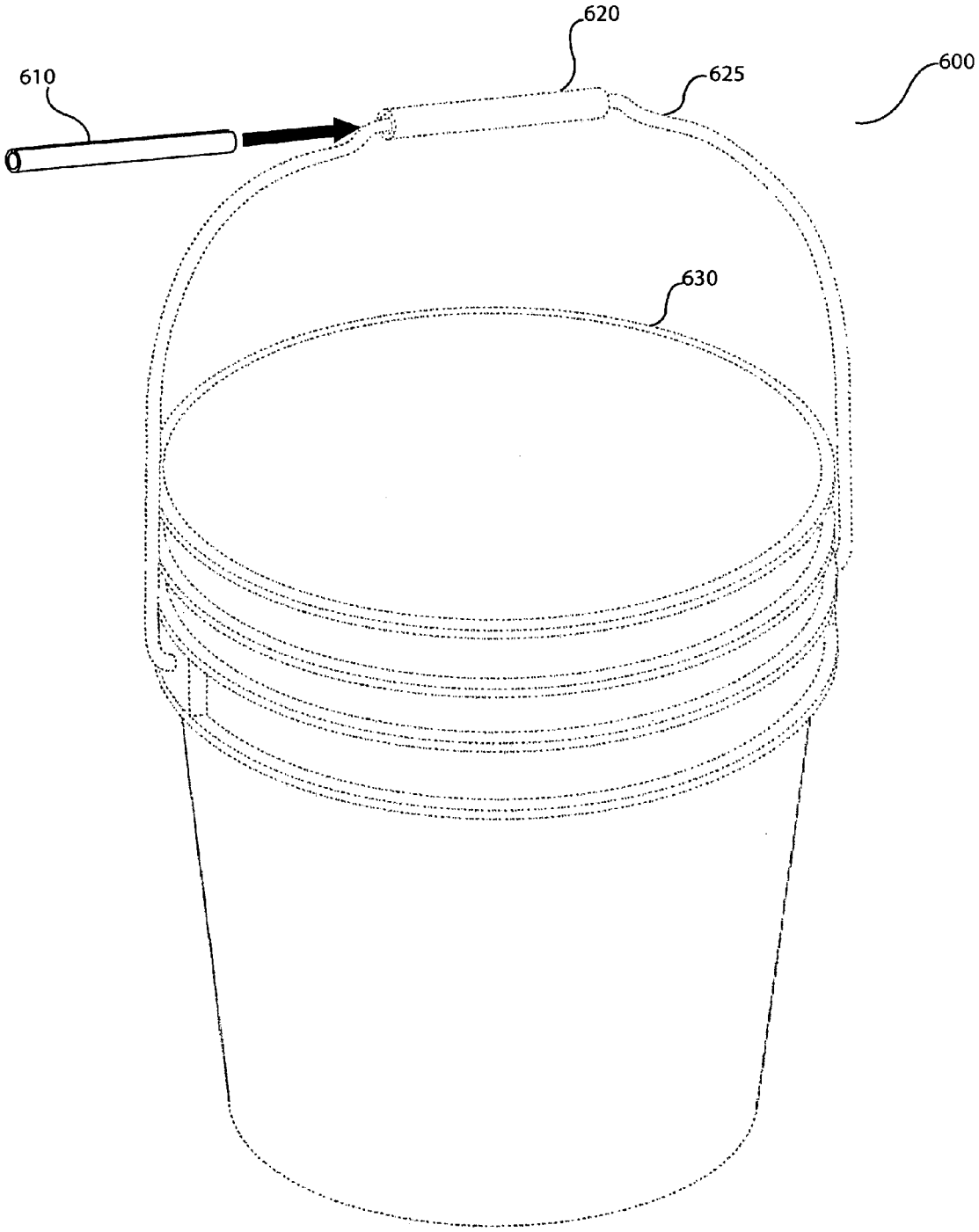
FIG. 6 illustrates an insert for a bucket handle according to another embodiment of the invention.

FIG. 6 illustrates an insert 610 for a bucket handle 620 of bucket 600 according to another embodiment of the invention. In one embodiment of the invention, the bucket 600 is a typical bucket including a bucket portion 630, a wire carrying portion 625 and bucket handle 620. In one example, the insert 610 is made of rubber, hardened plastic, metal, metal alloy, wood, etc. In one embodiment of the invention, the insert 610 stabilizes or prevents movement of the bucket handle 620, which otherwise would rotate around the wire carrying portion 625. In one embodiment the insert 610 is split so that the insert 610 may be easily placed over the wire carrying portion 625 and within the bucket handle 620. In one example, the insert 610 provides friction and pressure against the wire carrying portion 625 and the bucket handle 620.

Figure 7:
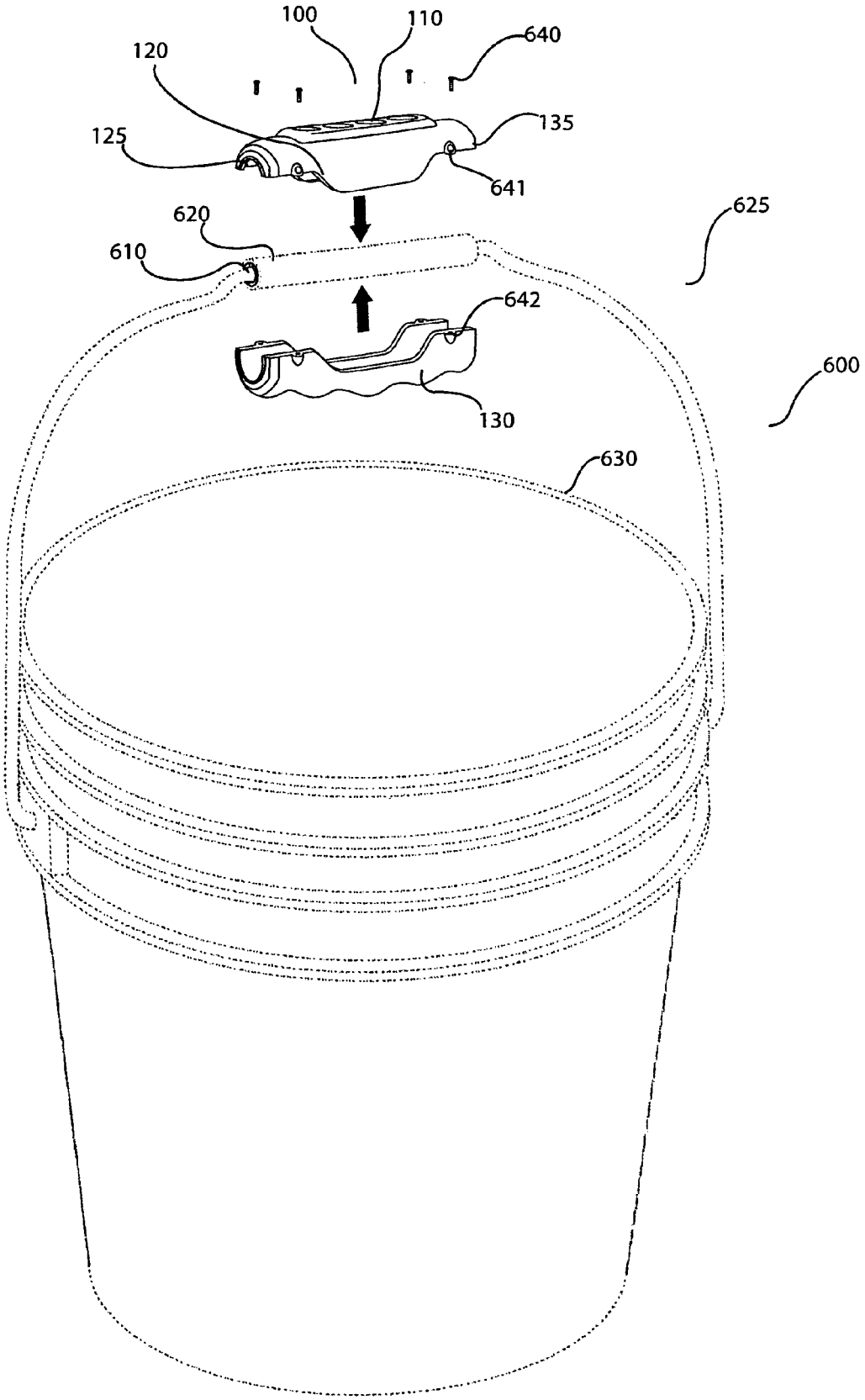
FIG. 7 illustrates an exploded view of a light source for a bucket handle according to an embodiment of the invention.

FIG. 7 illustrates an exploded view of a light source 100 that is sized for connecting to the bucket handle 620 according to an embodiment of the invention. In one example, the upper portion 120 and the lower portion 130 are connected together (in the direction of the arrows) around the bucket handle 620 and secured by fastening means 640, such as screws or similar devices, that are placed into an upper fastening portion 641 and screwed into a lower fastening portion 642. In one embodiment of the invention, the light source 100 includes circuit 400.

Figure 8:
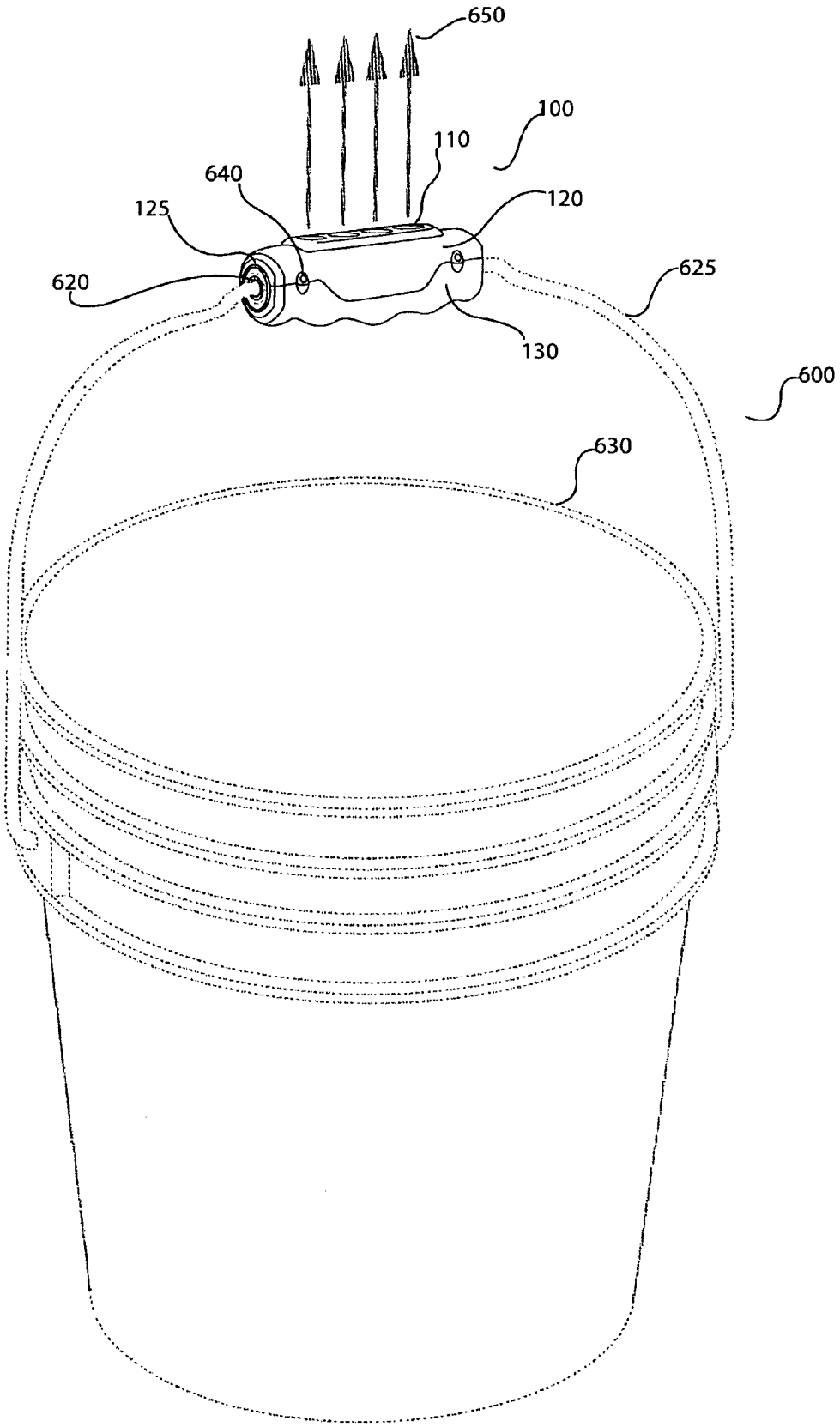
FIG. 8 illustrates a perspective view of a light source shown in a first position for lighting according to one embodiment of the invention.

FIG. 8 illustrates a perspective view of the light source 100 shown in a first position for providing lighting in the direction of the arrows 650 when placed in an "on" state upon the circuit 400 providing power to the lighting element 110 according to one embodiment of the invention. In this lighting position, a user may light a surrounding work area in the direction of the arrows 650 without having to hold a light source, such as a flashlight, when natural light or other light sources are not available.

Figure 9:
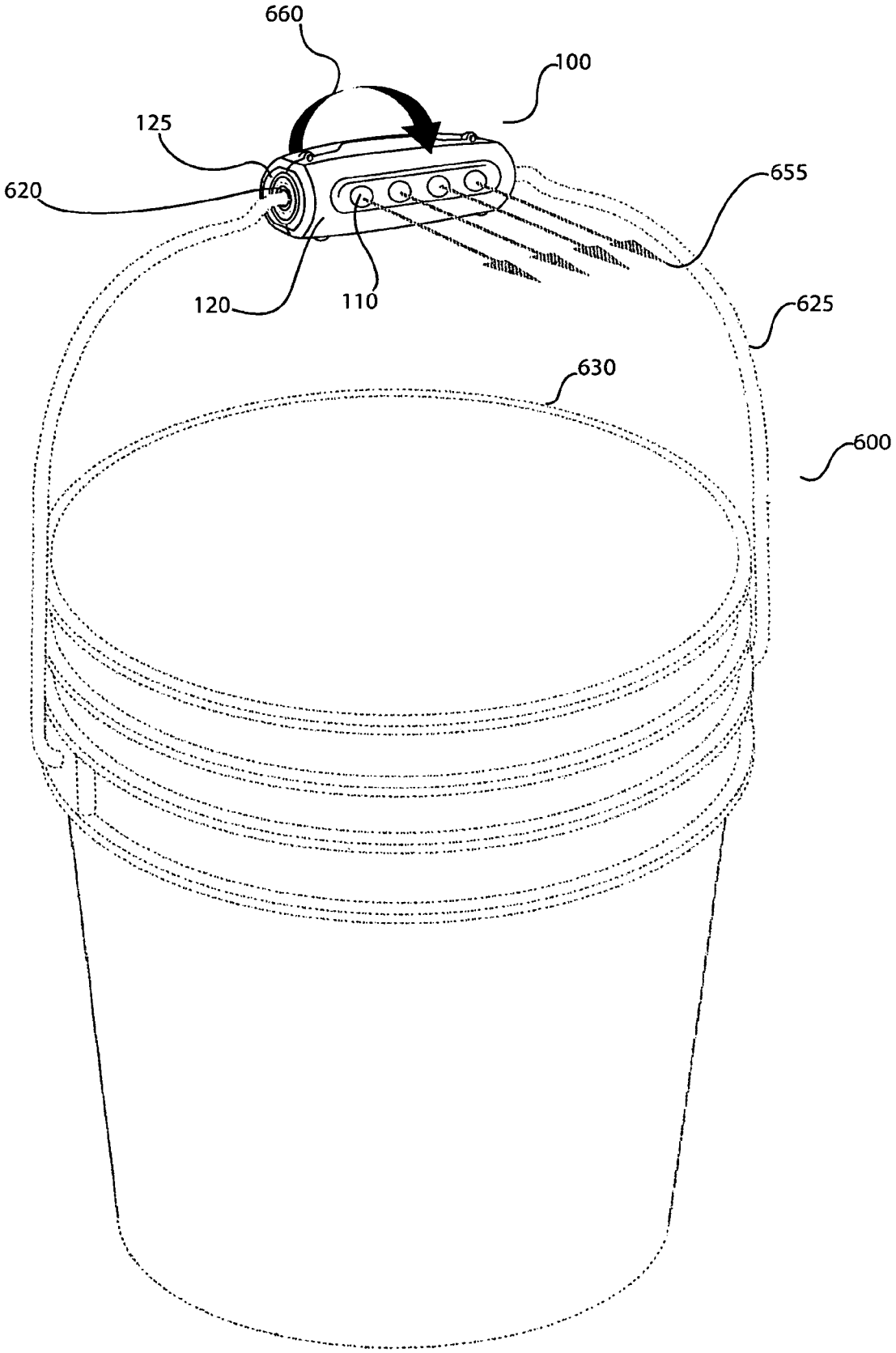
FIG. 9 illustrates a perspective view of a light source shown moving to a second position for lighting according to one embodiment of the invention.

FIG. 9 illustrates a perspective view of the light source 100 shown moving/rotating to a second position in the direction of the arrow 660 for providing lighting in the direction of the arrows 655 according to one embodiment of the invention. With the light source providing lighting in the direction of the arrows 655, a user may light a surrounding work area without having to hold a light source, such as a flashlight, when natural light or other light sources are not available. In one example, the insert 610 holds the bucket handle in a stationary or locked position around the wire carrying portion 625 and the light source 100 rotates around the bucket handle 620. In another example, the light source 100 rotates with the bucket handle 620, which may be forced to rotate around the wire carrying portion 625 with the insert 610 provides friction to hold the light source 100 in a desired position.

Figure 10:
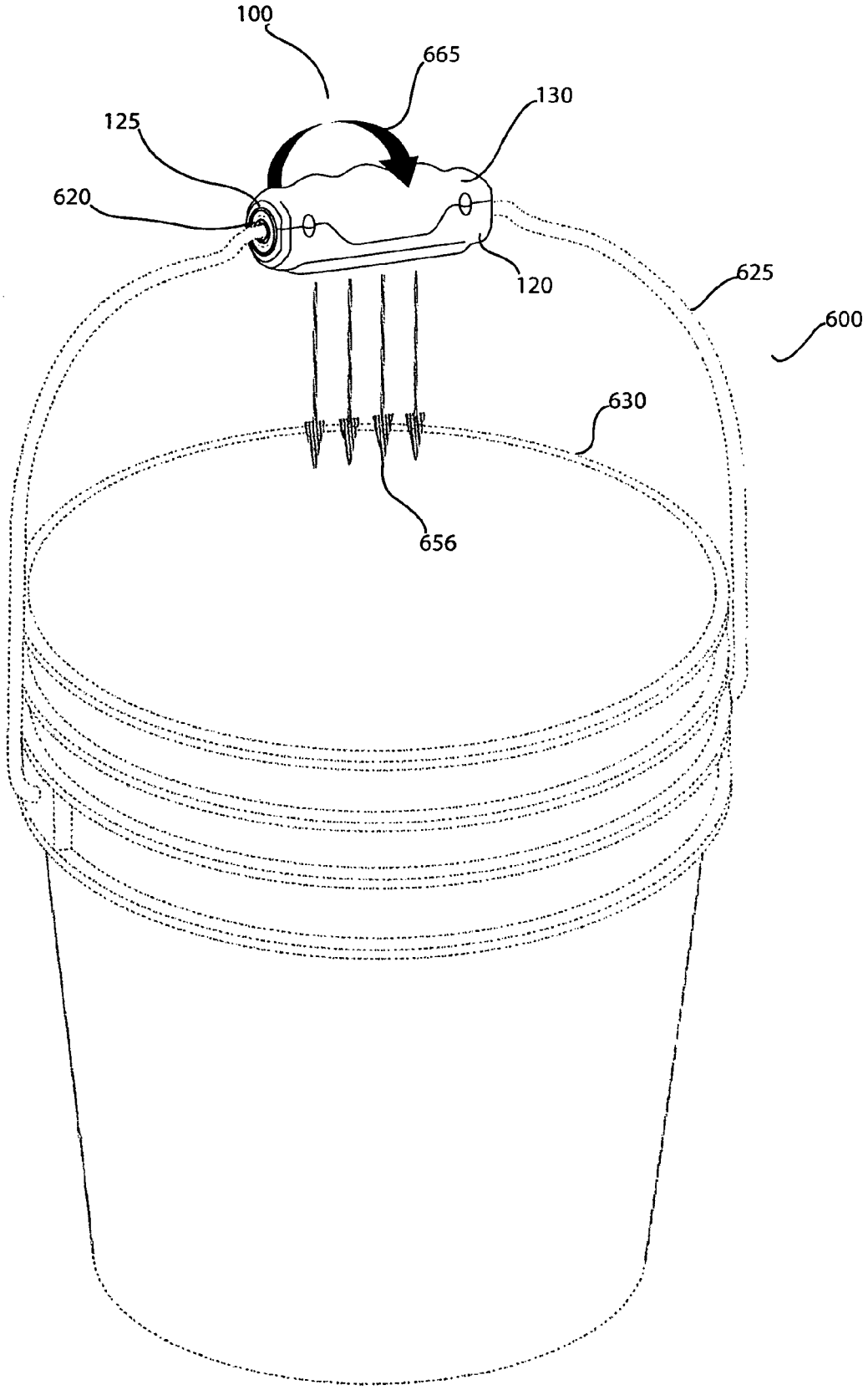
FIG. 10 illustrates a perspective view of a light source shown moving to a third position for lighting according to one embodiment of the invention.

FIG. 10 illustrates a perspective view of the light source 100 shown moving/rotating to a third position in the direction of the arrow 665 for providing lighting in the direction of the arrows 656 according to one embodiment of the invention. In this example of rotation, the light source 100 provides lighting into the bucket 630, which illuminates the inner portion of the bucket 630. This direction of lighting is useful for users so that the contents of the bucket 630 may be illuminated when natural or other lighting may not be available.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A lighting device comprising:

at least one light source;

a switch device coupled to a power source and the light source;

a light source body coupled to the light source, the light source body includes a separate upper portion and a separate lower portion that couple to each other forming an opening for coupling around a handle of a utility bag, wherein the separate upper portion includes a first upper fastening portion and a second upper fastening portion, and the separate lower portion includes a first lower fastening portion and a second lower fastening portion, the first upper fastening portion couples to the first lower fastening portion with a first fastener, the second upper fastening portion couples to the second lower fastening portion with a second fastener, and the separate lower portion includes a hand grip portion;

a first anchor device coupled to a first end of the light source body;

a second anchor device coupled to a second end of the light source body, wherein the first anchor device and the second anchor device are each coupled to a sleeve that is coupled to the handle of a utility bag;

wherein the light source body rotates around the handle for multi-positional lighting, the light source comprises a plurality of light emitting diodes, the first anchor device and the second anchor device are fixed to the sleeve via compression for friction, and the light source provides positional lighting to an interior portion of a utility bag and for targeting lighting away from the utility bag.

2. The lighting device of claim 1, wherein the switch device comprises a sensor device.

3. The lighting device of claim 2, wherein the sensor comprises a position determining sensor, a light sensor, or a combination of the position determining sensor and the light sensor.

4. The lighting device of claim 1, wherein the light source body is permanently affixed to the handle of the utility bag.

5. A lighting device kit comprising:

a light source body including a separate upper body portion and a separate lower body portion that couple to each other forming an opening for coupling around a handle of a utility bag, wherein the separate upper portion includes a first upper fastening portion and a second upper fastening portion, and the separate lower portion includes a first lower fastening portion and a second lower fastening portion, the first upper fastening portion couples to the first lower fastening portion with a first fastener, the second upper fastening portion couples to the second lower fastening portion with a second fastener, and the separate lower portion includes a hand grip portion, wherein the separate upper body portion removably couples with the separate lower body portion;

a light source coupled to the first body portion;

a switch device coupled to a power source and the light source, wherein the power source comprises one or more batteries;

a first anchor device coupled to a first end of the light source body;

a second anchor device coupled to a second end of the light source body, wherein the first anchor device and the second anchor device are each couple to a sleeve that couples to the handle of the utility bag, wherein the light source body is removably coupled to the handle, the light source body rotates around the handle, the light source comprises a plurality of light emitting diodes, the first anchor device and the second anchor device are fixed to the sleeve via compression for friction, and the light source provides positional lighting to an interior portion of a utility bag and for targeting lighting away from the utility bag.

6. The lighting device kit of claim 5, wherein the switch device comprises a sensor device.

7. The lighting device kit of claim 6, wherein the utility bag comprises a plastic bucket that includes a wire carrying portion.

8. The lighting device kit of claim 7, further comprising an insert coupled internally to a bucket handle, wherein the light source body is coupled over the bucket handle.

* * * * *